US005699937A

United States Patent [19]

Canela

[11] Patent Number: 5,699,937

[45] Date of Patent: Dec. 23, 1997

[54] DRINKING CONTAINER WITH DOSAGE DISPENSER

[76] Inventor: Heriberto Canela, 8027 W. 14th Ave., Hialeah, Fla. 33014

[21] Appl. No.: 600,566

[22] Filed: Feb. 13, 1996

[51] Int. Cl.[6] ..... B67D 5/56

[52] U.S. Cl. ..... 222/129; 222/158; 604/78

[58] Field of Search ..... 222/129, 454, 222/158; 604/78

[56] References Cited

U.S. PATENT DOCUMENTS

| | | | |
|---|---|---|---|
| 594,087 | 11/1897 | Jenkins | 222/129 X |
| 2,787,267 | 4/1957 | Paiano | 604/78 |
| 3,810,470 | 5/1974 | Von Gunten | 604/78 |
| 4,810,245 | 3/1989 | Aagesen | 604/78 |
| 5,375,742 | 12/1994 | Mowrey | 222/158 X |

FOREIGN PATENT DOCUMENTS

| | | | |
|---|---|---|---|
| 432400 | 7/1935 | United Kingdom | 604/78 |

*Primary Examiner*—Gregory L. Huson
*Attorney, Agent, or Firm*—J. Sanchelima

[57] ABSTRACT

A container that includes a dosage dispenser mounted therein and having an opening that is aligned with the rim of the container so that a user may pour out or drink the contents of the container and the dosage dispenser simultaneously. Scale markings on the container and the dosage dispenser permit a user to ascertain the amount of liquid in each. The opening of the dispenser is aligned with the rim of the container wall.

4 Claims, 1 Drawing Sheet

DRINKING CONTAINER WITH DOSAGE DISPENSER

BACKGROUND OF THE INVENTION

1. Field of the Invention.

The present invention relates to a container, and more particularly, to the type that includes a dosage dispenser that permits a user to drink a predetermined amount of a liquid simultaneously with the liquid contained in the drinking container.

2. Description of the Related Art.

Many containers have been designed in the past to permit a user to measure the amount of liquid contained therein. Also, dosage containers have been designed in the past to control the amount of medicine or any other liquid to be administered to a user. However, none of these containers have combined a container with a dosage dispenser. This is particularly useful if it is desirable to pour or drink both liquids simultaneously, such as when a user wants to mask out the dosage liquid's taste.

SUMMARY OF THE INVENTION

It is one of the main objects of the present invention to provide a container that includes in the entire structure a dosage dispenser that permits a user to drink or pour a dosage liquid while she or he drinks a desire accompanying beverage.

It is another object of this invention to provide a container with a dosage dispenser that permits a user to measure a dosage liquid and accompanying beverage to be drunk or poured.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 2:
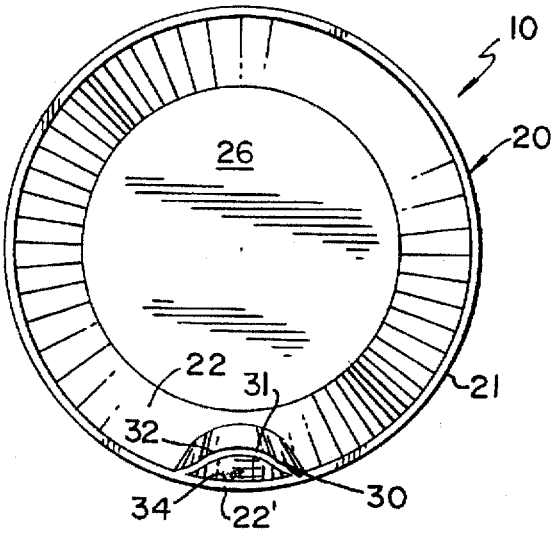
FIG. 2 is a top view of the this invention showing a dosage dispenser built-in therein.

Referring now to the drawings, where the present invention is generally referred to with numeral 10, it can be observed that it basically includes container 20 with dosage dispenser 30 therein.

Dosage dispenser 30, in the preferred embodiment, is defined by wall 32 and portion 22' of drinking container 20. Rim 21 of wall 22 and rim 31 of portion 22' define opening 34. Wall 32 extends inwardly and downwardly longitudinally along wall 22 towards bottom 26 of container 20. Dosage dispenser 30, is located preferably in the middle-uppermost portion of the inner surface of wall 22 container 20, thereby permitting a user to pour or drink through rim 21 the contents of dispenser 30 at the same time he or she is pouring or drinking the liquid contained inside container 20. A user does not need to use a teaspoon, or any other utensil, to ingest a predetermined dosage of a liquid (such as a medicine) along with a glass of water or juice, for instance, to dilute or mask the not infrequently disgusting taste of the dosage liquid to be swallowed.

Figure 1:
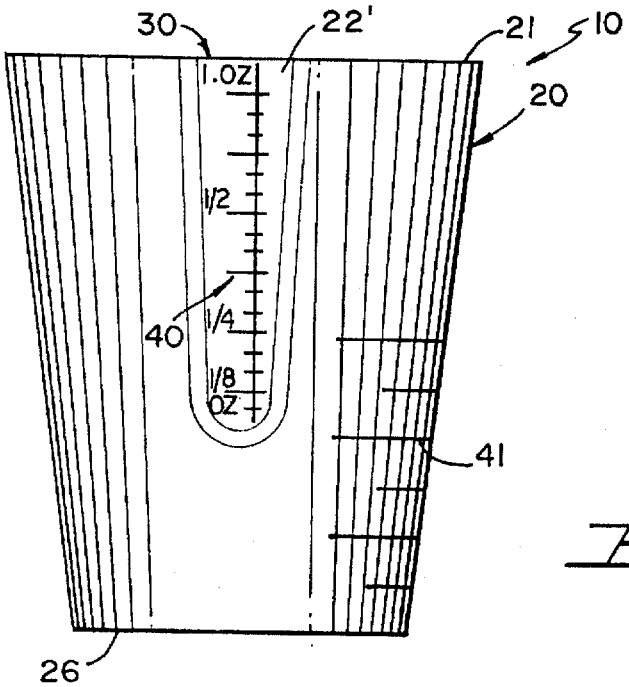
FIG. 1 is an elevational view of the present invention.
Figure 3:
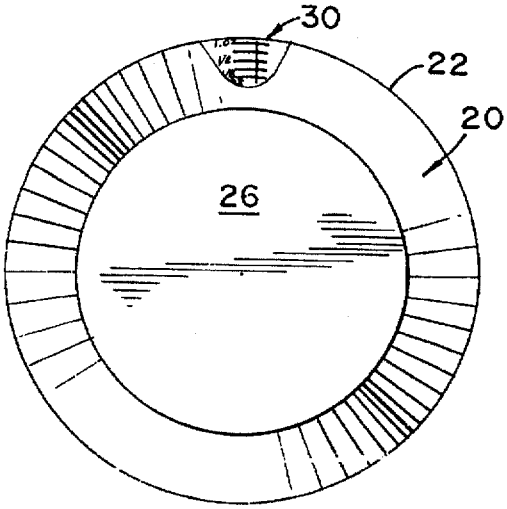
FIG. 3 is a bottom view of the invention represented in the previous two figures.

Scale markings 40 are shown in FIG. 1 to be placed on portion 22' of wall 22, and obviously this is done when container 20, or at least portion 22', is transparent or quasi-transparent. If portion 22' is opaque, then wall 32 needs to be transparent or quasi-transparent and scale markings 40 would be placed on wall 32 so that a user can readily ascertain the amount of liquid contained inside dosage dispenser 30.

Scale markings 41, in the preferred embodiment, is located on wall 22 of container 20. Scale markings 41 can be used in conjunction with scale markings 40 to measure the ratio of the two liquids to be administered or poured.

The foregoing description conveys the best understanding of the objectives and advantages of the present invention. Different embodiments may be made of the inventive concept of this invention.

It is to be understood that all matter disclosed herein is to be interpreted merely as illustrative, and not in a limiting sense.

What is claimed is:

1. A container having a bottom with a peripheral wall extending therefrom that includes an inner surface, and said peripheral wall includes a rim at the distal edge, said container being capable of holding a liquid comprising:

A) dispenser means mounted on said inner surface having an opening that lies in the same plane as said rim so that a user can withdraw the contents of said dispenser means simultaneously with the pouring of a liquid inside said container; and B) scale markings on said container and on said dispenser means so that a user can ascertain the volume of liquid inside said container and said dispenser means.

2. The container set forth in claim 1 wherein said dispenser means includes an inner wall that extends downwardly and longitudinally along said container.

3. The container set forth in claim 2 wherein said container and said dispenser means are transparent.

4. The container set forth in claim 2 wherein said container is opaque and said inner wall is transparent and said scale markings of said dispenser are located on said inner wall.

* * * * *